US005545438A

United States Patent [19]

Ouyang et al.

[11] Patent Number: 5,545,438

[45] Date of Patent: Aug. 13, 1996

[54] HYDROPHILIC TREATMENT FOR ALUMINUM

[75] Inventors: Jiangbo Ouyang, Media; Jeffrey I. Melzer, Lansdale, both of Pa.

[73] Assignee: Betz Laboratories, Inc., Trevose, Pa.

[21] Appl. No.: 408,766

[22] Filed: Mar. 22, 1995

[51] Int. Cl.[6] ..... B05D 3/00; B05D 1/18; C23C 22/07; F28F 13/18

[52] U.S. Cl. ..... 427/299; 427/435; 148/261; 165/133

[58] Field of Search ..... 427/318, 388.1, 427/374.1, 435, 427, 144; 106/287.29; 148/261; 165/133

[56] References Cited

U.S. PATENT DOCUMENTS

| | | | |
|---|---|---|---|
| 3,201,247 | 8/1965 | Leonard | 96/75 |
| 4,181,773 | 1/1980 | Rickert, Jr. | 428/329 |
| 4,253,999 | 3/1981 | Okishi | 260/17 R |
| 4,503,907 | 3/1985 | Tanaka et al. | 165/133 |
| 4,588,025 | 5/1986 | Imai et al. | 165/133 |
| 4,718,482 | 1/1988 | Iwana et al. | 165/133 |
| 5,012,862 | 5/1991 | Espeut et al. | 165/133 |
| 5,342,871 | 8/1994 | Clinnin et al. | 524/238 |
| 5,344,505 | 9/1994 | Ouyang et al. | 148/261 |

FOREIGN PATENT DOCUMENTS

| | | |
|---|---|---|
| 0409130 | 1/1991 | European Pat. Off. . |
| 1359339A | 5/1986 | U.S.S.R. . |
| 94/01593 | 1/1994 | WIPO . |

*Primary Examiner*—Shrive Beck
*Assistant Examiner*—Fred J. Parker
*Attorney, Agent, or Firm*—Alexander D. Ricci; Steven D. Boyd

[57] ABSTRACT

A hydrophilic coating for aluminum comprising a substantially chromium-free treatment including phosphoric acid, boric acid and optionally molybdic acid.

1 Claim, No Drawings

HYDROPHILIC TREATMENT FOR ALUMINUM

FIELD OF THE INVENTION

The present invention relates to a method of forming a hydrophilic coating on aluminum surfaces. More particularly, the present invention relates to a substantially chromium-free method of forming a hydrophilic surface on the surfaces of aluminum heat exchangers.

BACKGROUND OF THE INVENTION

A heat exchanger typically comprises a plurality of parallel spaced apart fins defining air flow passages. The fins are often made of aluminum because of its excellent heat conductance and are designed to have as large a surface area as possible in order to increase the heat radiation and cooling effect. The spacing between adjacent fins is narrow in order to provide more cooling surface area in as small a space as possible. As a result, particularly when the exchanger is used for cooling, moisture from warm air passing through the exchanger condenses on the cold fin surfaces and, if those surfaces are hydrophobic, beads of water accumulate and can block the narrow passages between fins. This phenomenon is called bridging. The increased resistance to air flow caused by bridging reduces the efficiency of the heat exchanger. In order to inhibit the accumulation of water between the fins, the surfaces of the fins are preferably made hydrophilic so that a thin film of water coating the surface can slide off quickly, a phenomenon known as sheeting off.

Various methods exist for making such surfaces hydrophilic. These methods include coating the surface with acrylic acid resin alone or with a mixture of the resin and sodium silicate; or treating an aluminum surface with a continuous film of a water soluble basic polymer having colloidal aluminum dispersed therein and curing the polymer to water insolubility followed by hydrolyzing the surface of the cured polymer film. See U.S. Pat. No. 4,181,773. In U.S. Pat. No. 4,503,907 a mixture of water soluble acrylic resin and a water soluble amino resin is mixed with a synthetic silica and a surface active agent such as a polyoxyethylene glycol and the mixture is applied to a fin surface and baked. U.S. Pat. No. 4,588,025 discloses a fin treatment containing an alkali silicate and a carbonyl-containing low molecular weight organic compound such as an aldehyde, ester or amide. U.S. Pat. No. 5,012,862 discloses a coating of polysulfonic acid on aluminum heat exchanger fins to render the surface hydrophilic. U.S. Pat. No. 5,342,871 discloses a combination of an ethylene/acrylic acid copolymer and a water soluble amine salt of a fatty acid as providing a hydrophilic coating for heat exchanger fin surfaces.

The majority of prior art methods for imparting a hydrophilic surface to aluminum surfaces involve applying water soluble polymers. While such methods generally provide good hydrophilicity when freshly applied, the hydrophilicity often decreases after exposure to air and/or water. The long retention of hydrophilicity on the aluminum surfaces of fin type heat exchangers is critical to performance.

SUMMARY OF THE INVENTION

The present inventors have discovered a method of imparting persistent hydrophilicity to aluminum surfaces. The method of the present invention involves a single application step, that is it does not require curing or baking.

However, curing or baking may be employed if desired, i.e., forced drying, without detrimental effects on the performance of the treatment of the present invention. The method of the present invention comprises treating an aluminum surface with an aqueous treatment solution including phosphoric acid, boric acid, and optionally molybdic acid. The treatment solution is substantially free of chromium. By substantially free of chromium it is meant that while trace amounts of chromium may be present, no chromium is intentionally added to the treatment solution.

DETAILED DESCRIPTION OF THE PREFERRED EMBODIMENT

The present inventors have discovered that a hydrophilic surface on aluminum can be formed by application of a treatment solution comprising phosphoric acid, boric acid, and optionally molybdic acid. The substantially chromium-free treatment solution provides a hydrophilic aluminum surface well suited for heat exchanger fins. The hydrophilic nature of the surface is maintained after long term exposure to various environments.

The treatment solution of the present invention is an aqueous solution including phosphoric acid, boric acid, and optionally molybdic acid. The treatment solution can be applied by any conventional means including spraying, dip-squeegee, spin coating, immersion and roll coating. The treatment solution can be allowed to dry in place or, if desired, may be force dried by any conventional means. The treatment solution can include an appropriate biocide to prevent microbiological growth that can contribute to undesirable odors.

The concentration ratios of the three components can vary depending upon the treatment requirements. The phosphoric acid concentration can range from about 0.5 to 50% by weight, the boric acid concentration can range from about 0.1 to 5% by weight and the molybdic acid concentration can range from 0 to about 5.0% by weight (weight percentages herein are based on the total treatment solution). A preferred treatment solution comprises an aqueous solution of 2.0% of 75% phosphoric acid, 0.2% boric acid and 0.2% molybdic acid. A most preferred treatment solution comprises an aqueous solution of 1.0% by weight phosphoric acid, 0.1% boric acid and 0.1% molybdic acid. The treatment solution can comprise from a trace up to about 100% of the acid components. Application can be carried out at temperatures of from room temperature up to about 200° F.

A typical treatment process employing the treatment solution of the present invention can include: cleaning the aluminum surface with an alkaline or acidic cleaner followed by ambient tap water rinsing and applying the treatment solution by appropriate means. The cleaning and rinsing stages prior to treatment solution application may not be necessary if the metal surface is not heavily soiled.

The invention will now be further described with reference to a number of specific examples which are to be regarded as illustrative and not as restricting the scope of the invention.

EXAMPLES

The treatment solution of the present invention was evaluated for its ability to maintain hydrophilicity on aluminum surfaces through water contact angle measurements with or without aging in air or water. Water contact angle quantitatively characterizes the water wettability of aluminum surfaces. Water contact angle is measured as follows: a syringe is placed with the delivery point about 5 mm from a test panel. About 20 μl of deionized water is dropped onto the panel. After a few seconds, the contact angle of the water drop on the panel is measured using a goniometer. A low contact angle (<10 degrees) signifies a hydrophilic surface upon which water wets spontaneously. Generally, contact angles of less than 30 degrees signify a hydrophilic surface. The following treatment solutions were evaluated:

TABLE I

| Treatment Solution | Description |
|---|---|
| A | 20.0% of 75% phosphoric acid, 2.0% boric acid and 2.0% molybdic acid. |
| B | acidic pretreatment of acrylic acid or maleic acid/ polyethyleneglycol allyl ether copolymer (available as Permatreate ® 1011*). |
| C | alkaline polyacrylamide pretreatment (available as DC-2062*). |
| D | alkaline pretreatment of aminopropylsilane, sodium silicate and polyacrylamide (available as DC-2065*). |

*All are available from Betz Laboratories, Inc. of Trevose, PA.

Example 1

Treatments A, B, C and D were immersion applied to 1100 alloy 0 temper aluminum surfaces after cleaning with DC-1675 (an alkaline cleanser containing sodium phosphate available from Betz Laboratories) and soaking/rinsing with tap water. The water contact angle was measured on freshly prepared surfaces. All treatments had low water contact angles (between about 10°–25°); i.e., were hydrophilic, within several hours of preparation. The surfaces treated with Treatments B, C and D became hydrophobic with water contact angles increasing to more than 40° over several days. The surface treated with Treatment A remained hydrophilic.

Example 2

Aluminum (1100 alloy with 0 temper) was dip cleaned in 5% DC-1675 for 20 seconds at 125° F. After soaking and rinsing with tap water for 5 seconds, aluminum panels were immersed in 10% Treatment A for 5 seconds, followed by squeegeeing. The treated aluminum panels were dried either at ambient temperature or at various elevated temperatures. Water contact angles were measured and shown in the following table.

TABLE II

WATER CONTACT ANGLE MEASUREMENT

| | | Water Contact Angle (°) | | |
|---|---|---|---|---|
| Treatment | Dry Temp. (°F.) | Fresh | Aged In Air | Aged In Water |
| Clean Only | Ambient | 13 | 41 | 8 |
| A | Ambient | 10 | 23 | 11 |
| A | 100 | 7 | 10 | 8 |
| A | 400 | 10 | 16 | 14 |

Example 3

Q-panel aluminum of 3003 alloy was cleaned with 40 second spray with 0.1% Solv® 195 (mixture of ethoxylated surfactants available from Betz Laboratories, Inc.) at 115° F., rinsed with ambient tap water, immersion cleaned with 2.5% Bezt Kleen® 175 (nitric acid based cleaner available from Betz Laboratories, Inc.) for 66 seconds at ambient temperature, rinsed with ambient tap water again, then immersion treated with 5% Treatment A at various pH's for 132 seconds at ambient temperature, and followed by oven drying at 200° F. for 8 minutes. The natural pH of a 5% treatment A solution is 1.5, pH was adjusted with ammonium hydroxide. Water contact angles on the treated aluminum panels are shown in Table III.

TABLE III pH EFFECTS ON WATER CONTACT ANGLE

| pH (5% Treatment A) | Water Contact Angle (°) (Fresh Samples) |
|---|---|
| 1.5 | 15 |
| 2.3 | 5 |
| 3.1 | <5 |

Example 4

Automotive Plate Fin Evaporators made of aluminum were treated with Treatment A by immersion application. The surface hydrophilicity of the treated fin evaporators were examined using simulator testing. In the simulator testing, the evaporators were operated under standard operation conditions and vapor was allowed to condense on the evaporator surfaces. When forcing air flow through the water drop covered evaporator the pressure drop across the exchanger is characteristic of surface hydrophilicity. The less the pressure drop, the more hydrophilic is the surface. Table IV compares the pressure drop across a Treatment A treated evaporator with that across an evaporator produced at a commercial automotive plant with a multi-stage chrome-silicate treatment of the Ford Motor Company. Treatment A resulted in a more stable hydrophilic surface than the chromesilicate treatment, as evidenced by a lower pressure drop as the operating time of the evaporator unit reached 300 hours. This indicates greater film longevity.

TABLE IV

| | Pressure Drop (inches of water) in Simulator Testing | | | | |
|---|---|---|---|---|---|
| Treatment | 0 Hr | 100 Hr | 200 Hr | 300 Hr | 400 Hr |
| Treatment A | 0.12 | 0.18 | 0.21 | 0.23 | 0.24 |
| Chrome-Silicate | 0.08 | 0.12 | 0.18 | 0.24 | 0.28 |

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of forming a persistent hydrophilic surface on aluminum comprising contacting an aluminum surface with a substantially chromium-free aqueous treatment solution comprising from about 0.5 to 50% by weight phosphoric acid, from about 0.1 to 5% by weight boric acid and optionally from about 0.1 to 0.5% by weight molybdic acid for a period of time sufficient to form a persistent hydrophilic surface which retains its hydrophilic properties after exposure to air and/or water.

* * * * *